US005995882A

United States Patent [19]

Patterson et al.

[11] Patent Number: 5,995,882

[45] Date of Patent: Nov. 30, 1999

[54] MODULAR AUTONOMOUS UNDERWATER VEHICLE SYSTEM

[76] Inventors: Mark R. Patterson, 1489 Mercer Rd., Gloucester Point, Va. 23062-2603; James H. Sias, 190 Sylvan Rd., Rochester, N.Y. 14618

[21] Appl. No.: 08/797,976

[22] Filed: Feb. 12, 1997

[51] Int. Cl.[6] ..... G06F 17/00

[52] U.S. Cl. ..... 701/21; 701/200; 114/312

[58] Field of Search ..... 701/3–6, 21, 200; 114/312, 313, 314, 324, 328, 320; 244/3.1, 3.15, 3.21, 176; 73/178 R; 367/131, 132, 133, 134, 153, 165; 244/50

[56] References Cited

U.S. PATENT DOCUMENTS

| | | | |
|---|---|---|---|
| 5,121,702 | 6/1992 | Johnson et al. | 114/330 |
| 5,319,556 | 6/1994 | Bessacini | 701/21 |
| 5,370,074 | 12/1994 | Knudsen et al. | 114/312 |
| 5,631,830 | 5/1997 | Schroeder | 701/4 |
| 5,687,084 | 11/1997 | Wertz | 701/4 |
| 5,687,137 | 11/1997 | Schmidt et al. | 367/131 |

FOREIGN PATENT DOCUMENTS

| | | | |
|---|---|---|---|
| 2372076 | 11/1976 | France | B63G 8/00 |
| 547937A1 | 3/1992 | France | B63G 7/02 |
| 1500684 | 4/1971 | Germany | B63G 8/00 |

*Primary Examiner*—William A. Cuchlinski, Jr.
*Assistant Examiner*—Gertrude Arthur
*Attorney, Agent, or Firm*—Kaufman & Canoles

[57] ABSTRACT

An autonomous underwater vehicle system for ocean science measurement and reconnaissance is about six feet long and 13 inches in diameter and includes various improvements which make turn-key, networkable, autonomous or tethered operation in aquatic environments possible. The improvements include a platform independent computer and I/O architecture which permits use of CISC or RISC CPUs and turn-key vehicle operation by persons unversed in computer programming, a floating launch and recovery frame which protects the vehicle and also provides for correct and safe vehicle assembly, an external battery charging port and high speed serial port with provision for optional control of the vehicle and data acquisition in real-time through connection of a lightweight electrically conducting tether, a four part hull assembly including an integrated strobe and antennae tower on the forward hull section which emerges from the water when the vehicle is at the surface, a modular, removable nose cone to carry sensors, and a motor mount which protects the main hull from flooding in the event of thruster failure, and flexible control surfaces with dive planes located on the forward hull and rudder fins on the stern hull section. These features are combined to produce a versatile and flexible platform for making oceanographic observations during complex behaviors executed by the vehicle and for providing duplex computer network connections when the vehicle is at the surface.

8 Claims, 17 Drawing Sheets

To FIG. 12B

MODULAR AUTONOMOUS UNDERWATER VEHICLE SYSTEM

FIELD OF THE INVENTION

This invention relates to autonomous underwater vehicles (AUVs), and more particularly to AUVs that can be operated as part of a wireless network, be quickly outfitted with new sensor packages, and operated in either autonomous or tethered mode.

BACKGROUND OF THE INVENTION

Since the beginning of modern marine science, oceanographers throughout the world have been plagued by the problem of collecting underwater data. The depths of the ocean, and the inhospitality of that environment to mankind, have made it impossible for scientists to collect data in person in the same manner as their land-bound colleagues. Early in the science, oceanographers used non-mobile sensors attached to cables to probe the depths of the sea. However, these efforts were costly and inefficient, requiring an oceanographic expedition using large research vessels to collect data at limited spatial and temporal scales.

Over the last thirty years, the advent of a variety of underwater vehicles has helped to address these problems. These vehicles include: Remotely Operated Vehicles (ROVs), Unmanned Untethered Vehicles (UUVs), Autonomous Profiling Vehicles (APVs) and Autonomous Underwater Vehicles (AUVs).

Remotely Operated Vehicles (ROVs) used a tether to connect the underwater vehicle to a ship on the surface. The tether was the lifeline for the underwater vehicle, providing power and control signals to the vehicle as well as relaying data back to the operator. ROVs were an incremental gain over their non-mobile sensor counterparts. As long as tether integrity was not compromised, scientists could now move the sensor within a limited range of their craft.

The next class of vehicles, Unmanned Untethered Vehicles (UUVs), removed the problems of the tether. These vehicles replaced the tether with an acoustic, optical, or electromagnetic link to the ship-based operator. The major problem associated with the ROV (the limitation of the tether) had been solved; however, the data transmittal speeds available for underwater craft and their short communications range made these first UUVs highly limited in usefulness.

Autonomous vehicles addressed the limitations of the first UUVs by replacing the need for external operator control with vehicle-based controls. Autonomous Profiling Vehicles (APVs) could function without operator interaction; however, their movement capabilities were restricted to simple vertical movements within a water column. Autonomous Underwater Vehicles (AUVs) are self-propelled vehicles that execute underwater maneuvers autonomously through control signals generated by an on-board computer system. The control signals control the operation of thrusters, actuator-driven control surfaces, and optionally a buoyancy engine. AUVs meet the need for movement in all three dimensions within an ocean environment without operator control.

Much of the work in the prior art has focused on the optimization of AUV subsystems. Specifically, the most recent advancements in technology have focused on hull, navigation, control, communications, and sensor subsystem enhancement.

Prior art AUV hull construction has been of two types. The first, a single pressure hull (usually cylindrical in shape) has all electronics and sensors contained within the hull. The second type, a floodable hull has distinct electronics and sensor modules, each contained within water-tight housings within the hull. In the floodable hull, communications between the modules is accomplished through electrically conducting underwater cables. Both prior art systems have problems. The single pressurized hull does not allow for modular design and implementation of components. However, the flooded hull is more complex to fabricate and has more potential points of failure from water ingress, thereby increasing component sealing costs and failures.

AUV control systems have historically exhibited a wide variety of architectures, with serially distributed intelligent control systems widely favored in recent prior art efforts. Generally, the type of system used for control has been very specifically tailored to the particular AUV. Changes in architecture (for example, from a Complex Instruction Set Computer (CISC) to a Reduced Instruction Set Computer (RISC) Central Processing Unit (CPU) have required significant redesign of all hardware and software. The programming for the control function usually occurs in a lower level language like C or C++. Turn-key operator interfaces for programming AUV dive behaviors have not been implemented, with each dive scenario often requiring lengthy software development.

Communications with the AUV have been important, both for reprogramming the AUV and retrieving collected data; however, AUV communications subsystems in the prior art have been limited. Generally, access to the onboard computer has only been possible through direct physical attachment to a serial port. This means that access can only be achieved after the AUV has been recovered. Some recent prior art AUVs have included towed radio floats with radio antennae to establish a wireless (radio packet modem) connection with the operator upon surfacing. However, towed floats have been problematic for two reasons. First, the float and attachment cable limit the maneuverability of the vehicle and increase the likelihood of cable snags when operating in obstructed waters. Second, the float generally does not project high enough out of the water, resulting in lower transmission range and quality. AUVs are generally equipped with sensors of various types, both to ascertain their location and to make measurements in the ocean.

An industry-wide need exists for a low cost, multipurpose, networkable AUV system. The system should use off-the-shelf components programmable by non-experts in robotics. Also the system should provide sufficient depth range, working time, and behavioral capabilities to match mission requirements across the spectrum of tasks performed by scientists and engineers.

SUMMARY OF THE INVENTION

It is an object of this invention to provide a modular autonomous underwater vehicle (AUV).

It is another object of the invention to provide a modular AUV with wireless node operation.

It is still another object of the invention to provide platform independence of the vehicle's CPU.

It is yet another object of the invention to provide an integrated frame for assembly, damage protection and launch of an AUV.

It is still another object of the invention to provide an AUV with an integrated control and communications system.

In accordance with these and other objects, the invention is a modular underwater autonomous vehicle system comprising: (1) a floating launch and recovery frame for protection from damage during launch and recovery and which also provides for safe and correct vehicle hull assembly, (2) an integrated strobe and antennae tower directly attached to the vehicle housing to facilitate location of the vehicle at the surface and formation of a connection to a wireless computer network, (3) a computer and I/O architecture that permits the central computer to be platform independent, (4) provision for optional operation in tethered mode using a lightweight electrically conducting cable, (5) a removable nose cone as part of the pressure vessel optimized for integration of a variety of sensors, (6) a turn-key approach to vehicle programming and operation executable by persons unversed in computer programming, (7) control surfaces split between forward dive planes and aft rudders utilizing polymeric flexible fins that resist permanent deformation or breakage, and (8) a four piece pressure hull which includes a separate motor mount that prevents thruster failure from flooding the main pressure vessel.

The vehicle includes various improvements which make safe launch and recovery, data acquisition by different sensor arrays, operation in tethered and untethered mode with wireless network connections when surfaced, and platform-independent computer operation with turn-key operator interface, successful in aquatic environments.

The invention provides an autonomous underwater vehicle for use in acquiring data from the ocean through preprogrammed robotic behaviors. The vehicle has a body about six feet in length and 13 inches in diameter with an integrated strobe and antennae tower. Control surfaces are located in an unconventional manner with dive planes on the forward half of the vehicle just aft of the nose cone and rudder fins located forward of the thruster.

The invention features a pressure hull consisting of a removable nose cone, two main hull sections, the forward of which has an integrated strobe and antennae tower, and a motor (thruster) mount that permits electrical penetrators but prevents flooding of the main hull in the event of thruster failure. The removable nose cone is easily outfitted with a wide variety of standard or custom oceanographic sensors facilitating change of the vehicle's sensing capabilities in a matter of minutes. AUVs are expected to be used by a wide spectrum of ocean scientists and engineers and thus provision for quick reconfiguration of the vehicle's sensors by removal of a discrete, quickly disconnected nose cone, is a desirable attribute of this invention.

Another aspect of the invention is the strobe and antennae tower which emerges from the water when the vehicle is surfaced, providing a higher point of view for the high intensity strobe, quick shedding of seawater from the Global Positioning System (GPS) antenna, and better performance for the vertically polarized packet modem antenna by increasing its height above the conducting plane of the ocean's surface. Quick location of a surfaced AUV is a priority for safe operation and this invention provides for visual cues (strobe plus international orange paint on the tower) as well as quick position fixes by the water-free GPS antenna, said latitude and longitude positions being relayed over the packet modem connection via the packet modem antenna.

Another aspect of the invention is a floating launch and recovery frame which is used during vehicle assembly to position hull components correctly and safely, and then serves to protect the vehicle from damage from collision with deck machinery or the sides of a ship during launch and recovery operations. The positive buoyancy of the launch and recovery frame ensures that the vehicle plus frame will not be lost in the event of cable breakage. AUVs are complex swimming robots and provision for their protection during assembly, launch, and recovery is another desirable feature of the invention.

In still another aspect of the invention, a lightweight electrically conducting cable can be attached to a high speed serial port on the vehicle, allowing for optional operation in tethered mode which then provides real-time acquisition of data from the sensor-equipped nose cone, as well as real-time control of the vehicle's thruster and control surfaces. Additionally, connection to this port allows communication with the navigation and data collection computer at speeds which greatly exceed those obtainable via the wireless network connection. The ability to convert from untethered mode to tethered mode adds flexibility to the operation of the vehicle and essentially combines the functions of an AUV and ROV in one vehicle. Also, unlike a conventional ROV, the invention can suffer a broken or malfunctioning tether by returning to autonomous mode and performing self-recovery.

In another aspect of the invention, the navigation and data collection computer and I/O architecture and computer software utilized is platform independent, allowing use of CISC or RISC CPUs, with turn-key operation of the vehicle possible by persons unversed in computer programming. Previous AUV computer and I/O architectures developed at research centers are more complex to operate and require programming of the vehicle by persons versed in computer science. Additionally, in other AUVs developed to date, the overall system architecture is obligatorily dependent on a particular type or family of CPU.

BRIEF DESCRIPTION OF THE DRAWINGS

The foregoing objects and other advantages of the present invention will be more fully understood from the following detailed description and reference to the appended drawings wherein.

DETAILED DESCRIPTION OF THE INVENTION

Figure 1:
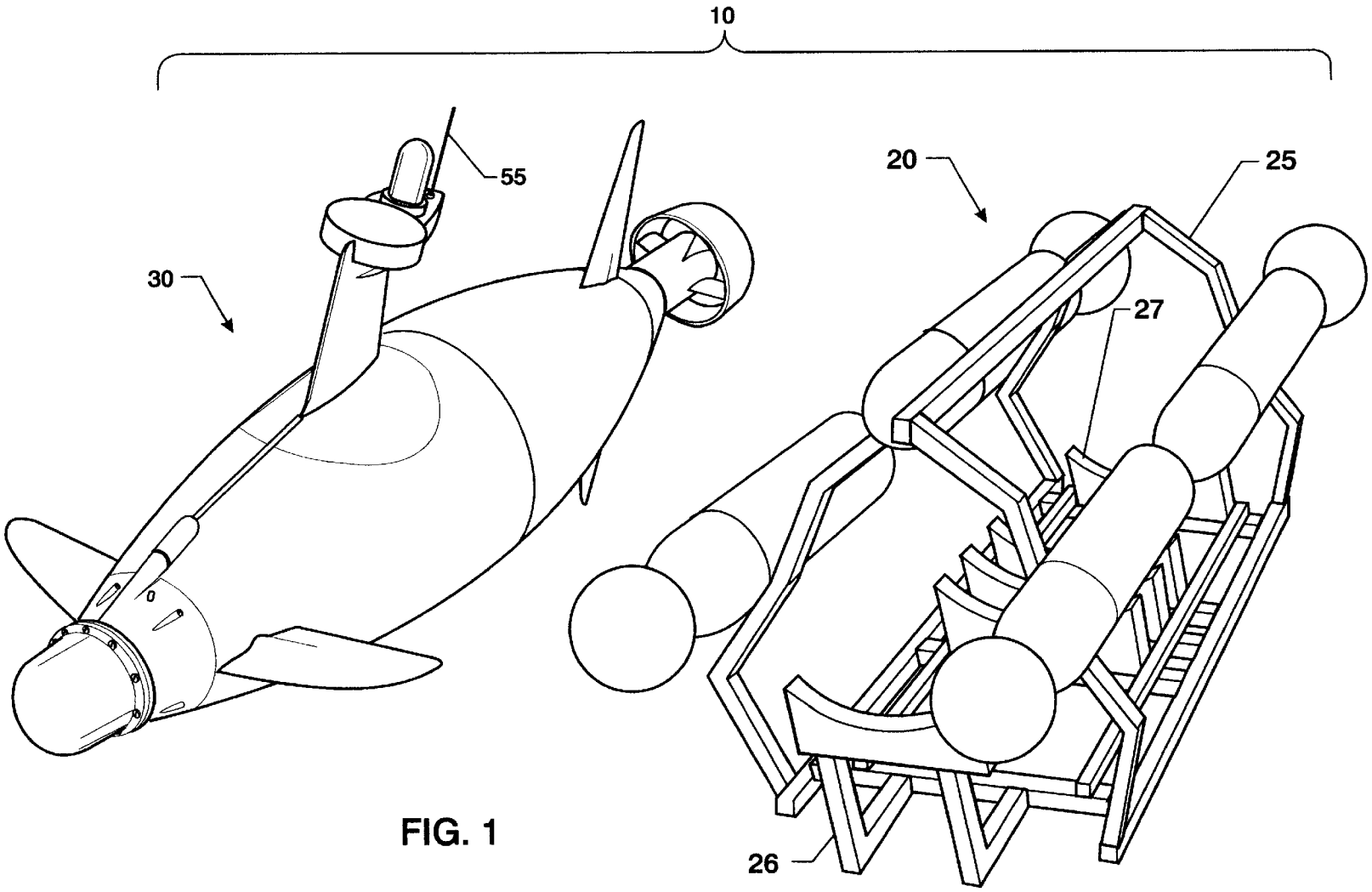
FIG. 1 is a perspective view of the vehicle system with the vehicle and launch and recovery frame.

Referring to FIG. 1, the Modular Autonomous Underwater Vehicle System 10 comprises two major components, the floating launch recovery frame 20 and the underwater vehicle (AUV) 30. The vehicle 30 is a battery-powered, self-propelled device which is approximately six feet in length and thirteen inches in diameter at its thickest point. Its overall weight without the frame 20 is approximately 170 lbs. The vehicle 30, when configured in its various modes, can extend up to about eight feet in length and have diameter up to fifteen inches at its widest point. The launch and recovery frame 20 includes one upper float frame 25 and two base halves. The two halves 26 and 27 of the base support slide fore and aft relative to each other to facilitate vehicle hull closure. During deployment, the slightly positively buoyant vehicle 30 is commanded via the packet modem module via modem antenna 55 to back slowly out the launch and recovery frame 20.

Figure 2:
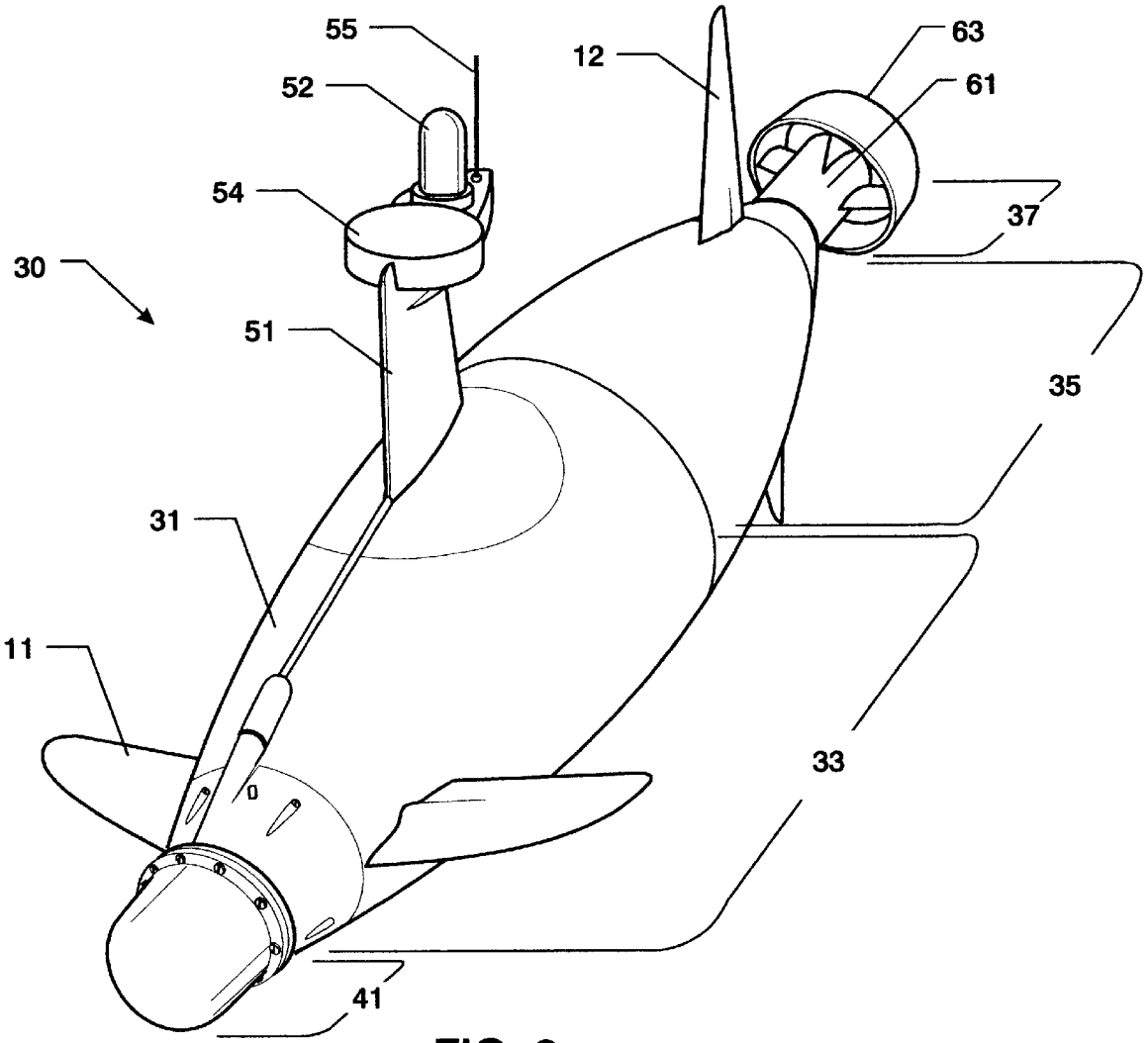
FIG. 2 is a perspective view of the vehicle shown in FIG. 1.

Referring now to FIG. 2, the vehicle 30 has a four part pressure hull 31 which includes a removable nose cone 41, forward hull 33 with an antenna tower 51 with an attached high intensity strobe 52, a GPS antenna 54 and a packet modem antenna 55, an aft hull 35, and a thruster assembly 37. A DC thruster 61 drives a ringed propeller 63. Direction and depth of the vehicle 30 is controlled by the dive planes 11 and the rudders 12.

Figures 3, 4:
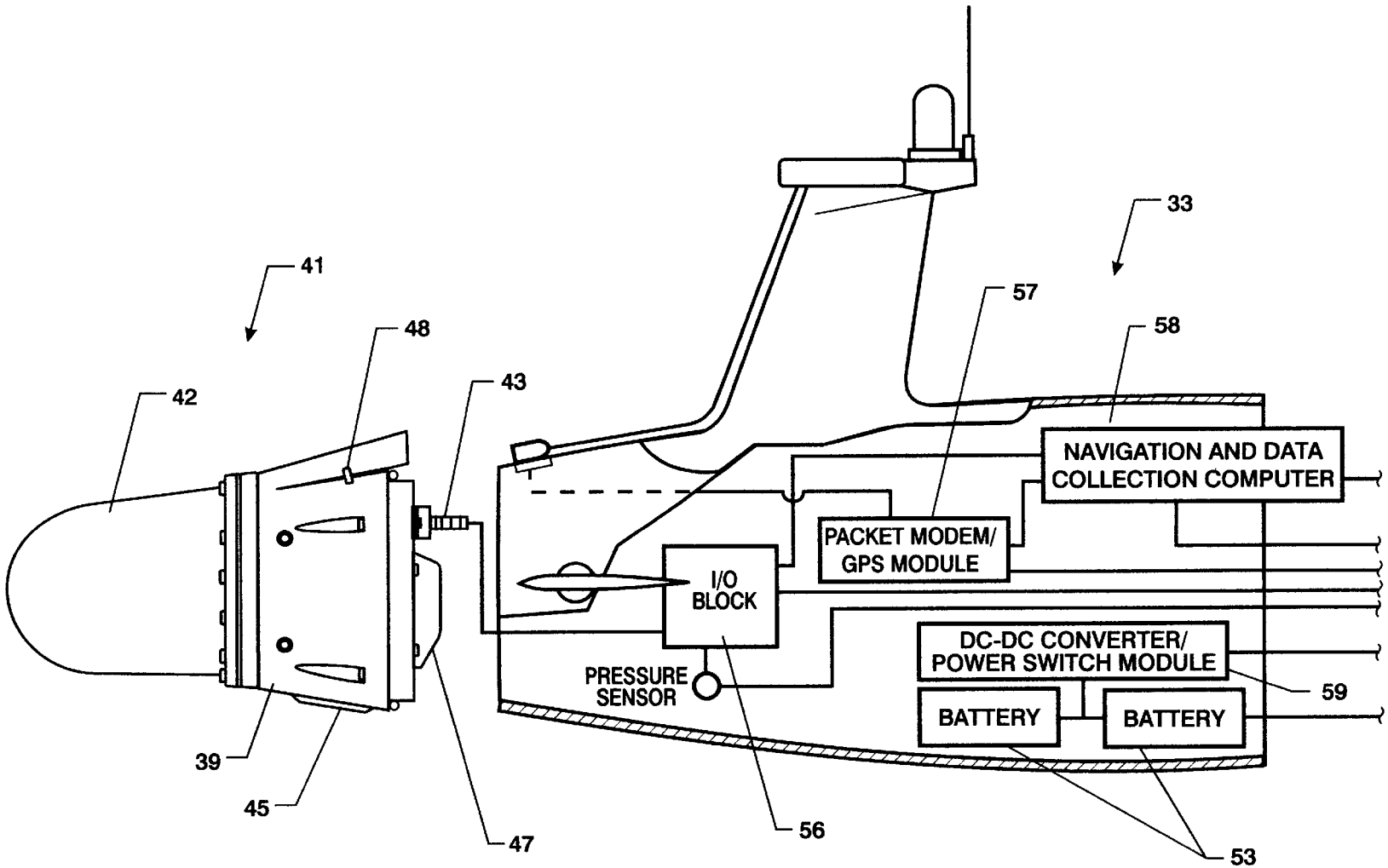
FIG. 3 is a side view of the removable nose cone.
FIG. 4 is a cutaway side view of the forward hull section.

Referring to FIG. 3, the location of three typical sensor systems in the removable nose cone 41 is indicated. A scanning sonar 42 is located in the forward section of the nose cone mounting body 39, with a port 45 for a high resolution video camera 47 located ventrally and facing forward, and a precision Pt RTD sensor 48 located dorsally. Preferably, other sensor configurations should have a similar form factor so as not to disrupt the hydrodynamic flow around the vehicle 30, but sensor packages which extend horizontally from the nose cone 41, e.g., the transducers of a side scan sonar array or a laser particle sizing unit, can be used with success. A sealed connector 43 provides electrical signals to the forward hull section 33 shown in FIG. 4.

In FIG. 4, the major internal components of the forward hull section 33 are shown. A battery bank 53 provides all vehicle power and preferably includes three or more sealed lead-acid gel cells, although other battery technologies such as $LiSO_2$, Li-Ion, NiCd, NiMH, Alkaline, or AgZnO batteries can also be used. Support brackets (not depicted) secure the batteries below the center of gravity of the vehicle 30 to provide roll stabilization. An I/O block 56 provides electrical power and data acquisition and I/O connections to sensors embedded in the nose cone. A packet modem and GPS module 57 house a radio transceiver, GPS receiver, packet modem, and strobe electronics. The navigation and data collection computer module 58 houses a RISC or CISC CPU, hard drive, 3 or 4-axis controller board for the dive and rudder stepping motors (or optionally a 3 or 4-axis controller board for servo motors), I/O board providing analog-to-digital converters, digital-to-analog converters, digital I/O lines, and a frequency counter, and frame-grabber card. DC-DC converters and power switch module 59 that must be heat-sinked are mounted on one of the support brackets (not shown).

Figure 6:
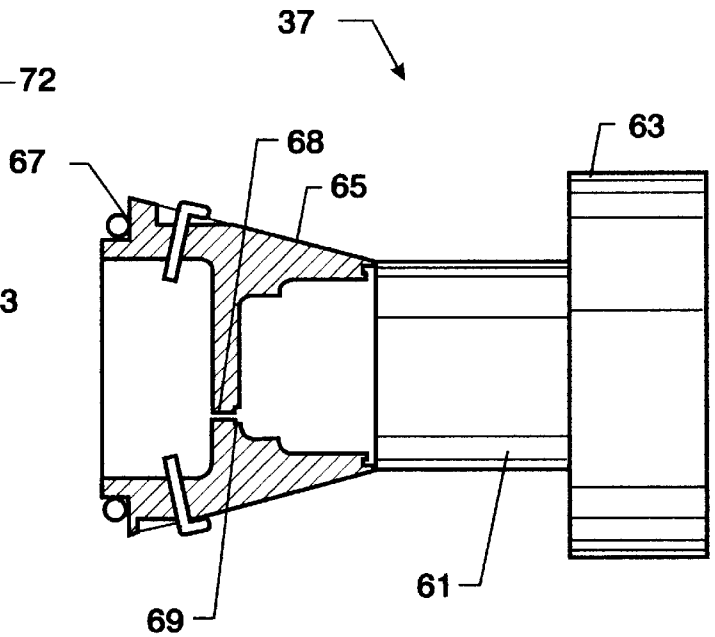
FIG. 6 is a side view of the thruster assembly with a cross-section of the motor mount.
Figure 5:
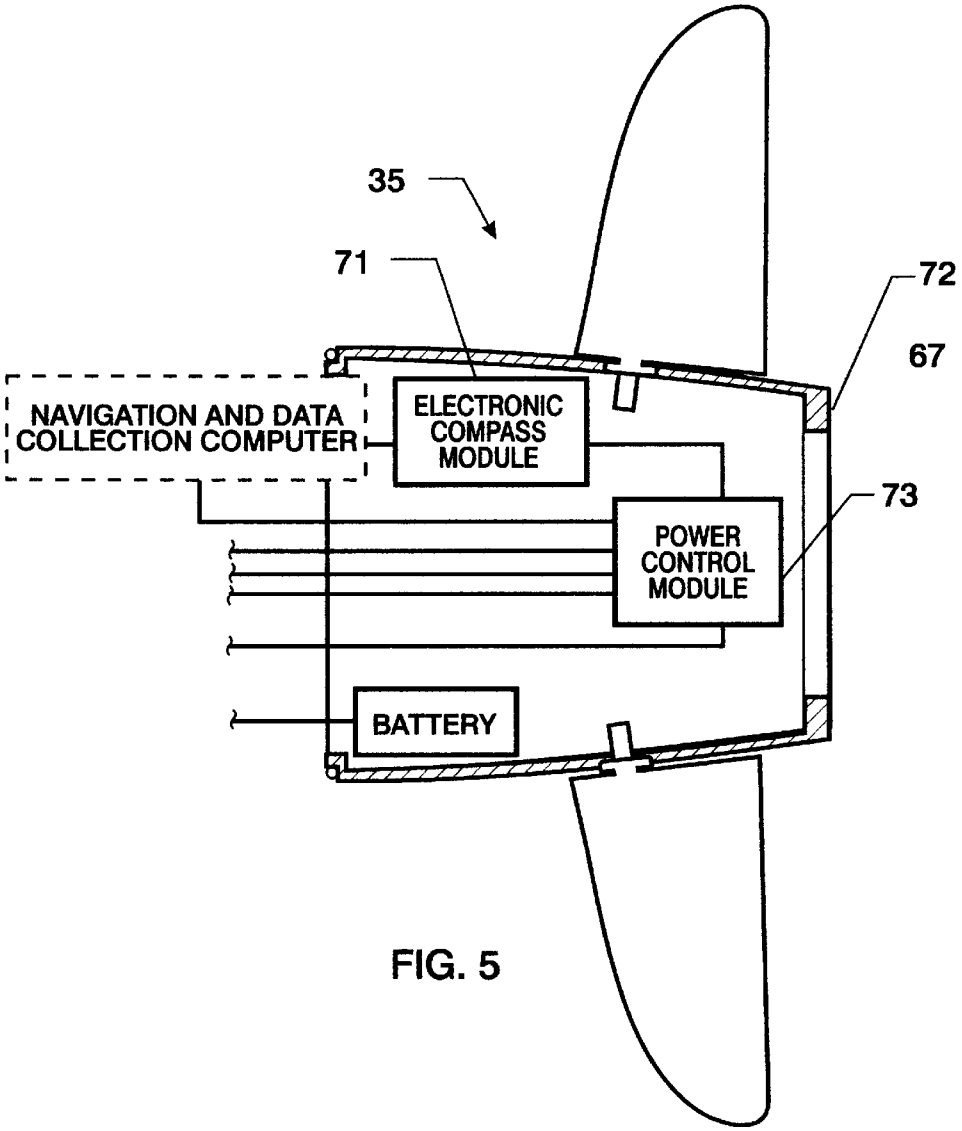
FIG. 5 is a cross-sectional side view of the aft hull section.

FIGS. 5 and 6 may be viewed side-by-side with FIGS. 3 and 4 to provide a general schematic of the entire vehicle 30 extending from left to right in the sequence 3, 4, 5, 6. Referring now to FIG. 5, the major components located in the aft hull 35 include a precision electronic compass module 71 providing vehicle heading, internal temperature, roll, pitch, and 3-axes of magnetic field information located dorsally in the aft hull 35 near the o-ring sealing surface 72. The power/control module 73 houses circuitry for generating precision voltages required by the navigation and data collection computer module 58 and the pressure sensor, digitally controlled relays, the control card for the DC thruster 61, and the three or four driver cards for the stepping motors.

FIG. 6 depicts a cross-section of the motor mount connected to the thruster assembly 37. The configuration of motor mount 65 provides a sealed water-tight assembly for connection to aft hull 35. O-ring seals 67 mate with O-ring sealing surface 72 on aft hull 35. The motor mount 65 also provides attachment for DC thruster 61 and with its attached ringed propeller unit 63, entire unit forming thruster assembly 37. A sealed electrical opening 68 allows electrical connection from the aft pressure hull 35 to the DC thruster 61. A small lip 69 accepts a sealing O-ring from the thruster side of the motor mount 65.

Figure 7:
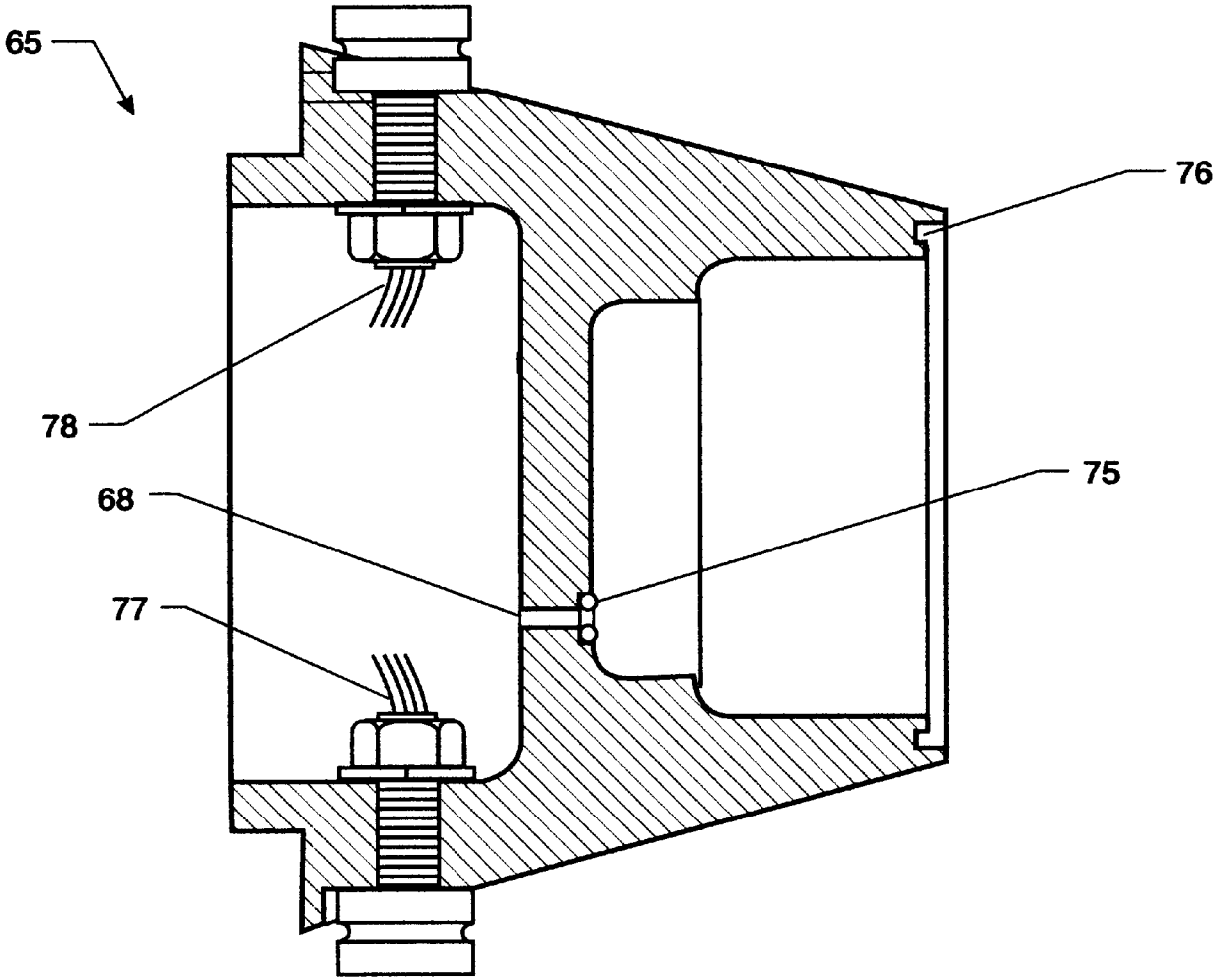
FIG. 7 is an enlarged cross-sectional view of the motor mount.

Referring now to FIG. 7, motor mount 65 is shown in cross-section with an O-ring 75 located at the sealed electrical opening 68. O-rings (not shown) are also located at the edge of the thruster at location 76. Connections allowing control or data recovery of the AUV by a remote computer or another AUV or vice versa, are achieved through the packet modem connection, or by connection of an Ethernet or serial cable to the high speed serial port 77. The ROV tether can be connected to either the ethernet transceiver or a conventional serial port; again both types of connections are accessed via the bifunctional high speed serial port 77 located on the motor mount 65. Battery charging port 78 and high speed serial port 77 are located on opposite sides of the motor mount 65.

Figure 8:
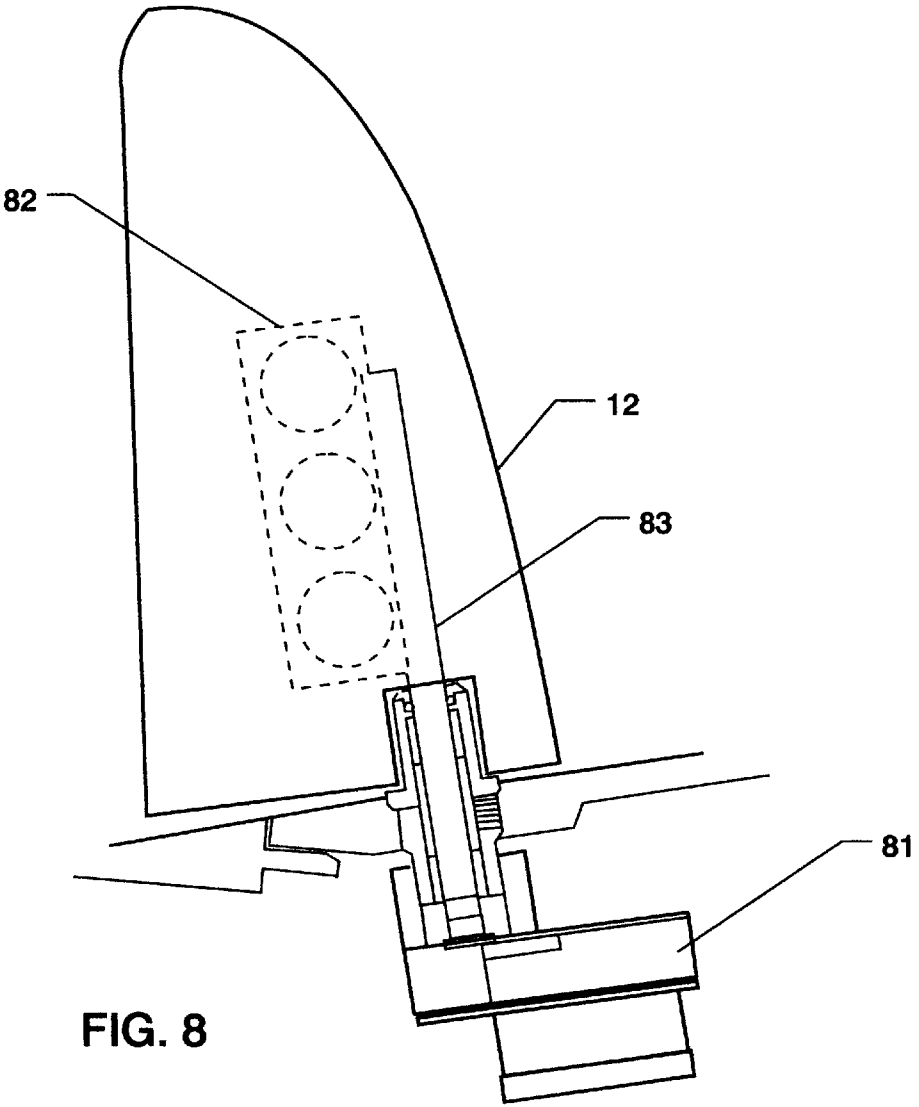
FIG. 8 is a side view of a rudder with a hull cross-section showing the stepper motor assembly.

FIG. 8 depicts the construction of the stepping motor 81 and the control surfaces, as shown in this figure by connection to a rudder 12. The control surfaces are polymeric material reinforced with an internal frame 82 attached to actuating rod 83 which is in turn attached to the stepping motor 81. The control surfaces are flexible fins that resist permanent deformation or breakage. Individual stepping motors 81 drive each of the dive planes 11 and rudder fins 12 for a total of four stepping motors.

Figure 9:
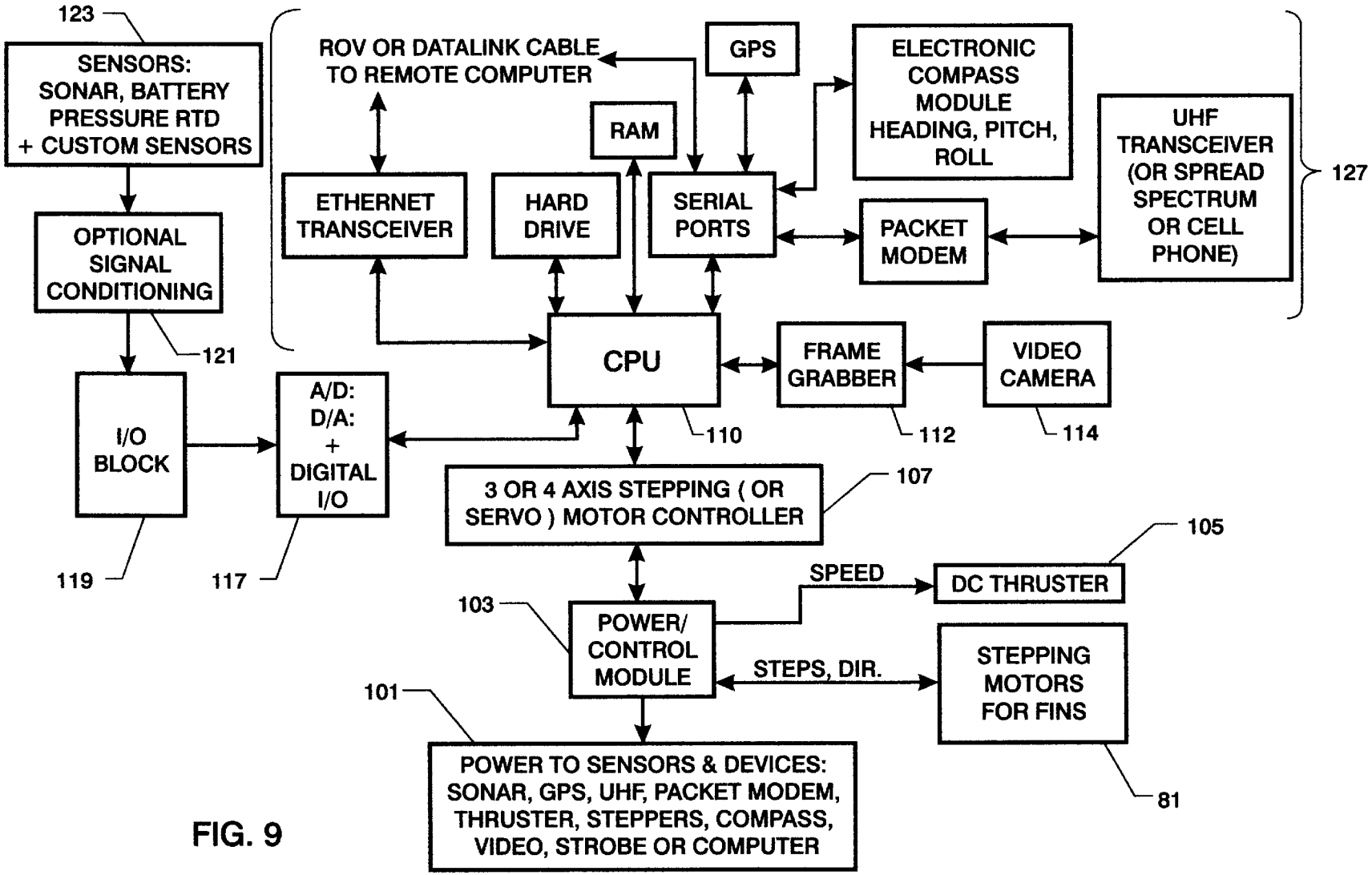
FIG. 9 is a block diagram depicting the hardware components and interfaces, defining the system architecture.

Referring now to FIG. 9, the functional arrangement of the electronic components is shown by block diagram. The power supply 101 provides power for all AUV functions including sensors, control surface motors, thruster and computer. A power control module 103 is connected to the DC thruster 105, stepping motor controller 107, and the stepping motors 81. Power is also provided to the CPU 110 which controls frame-grabber 112 and video camera 114. Additionally, A/D and D/A converters and digital I/O lines 117 are connected to CPU 110 and are further connected to I/O block 119 through a signal conditioning module 121 to sensors 123. The group of modules 127 provide navigation and control functions as depicted.

Figure 10:
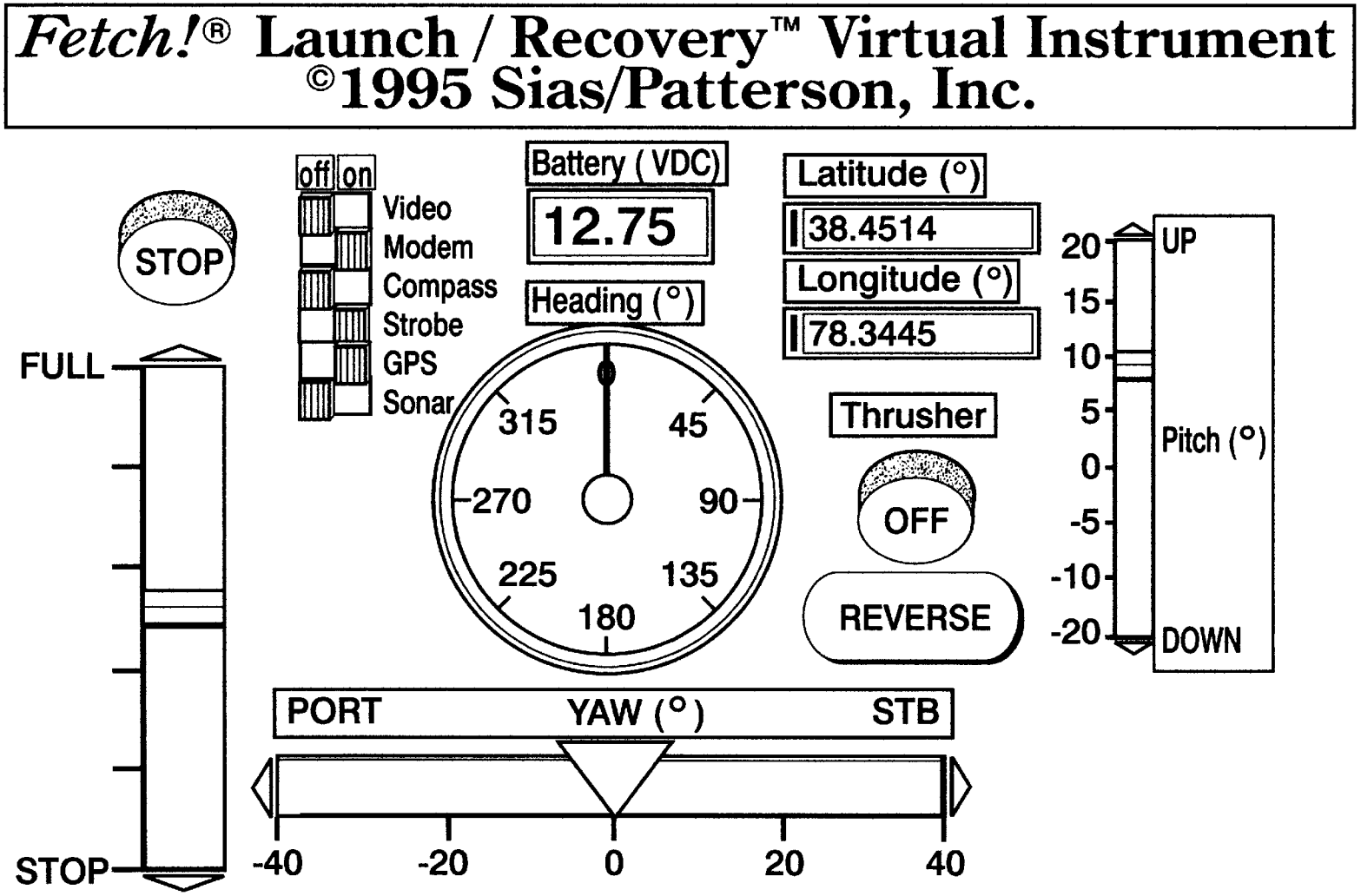
FIG. 10 is a computer control screen display for launch and recovery of the vehicle.

Referring now to FIG. 10, the launch and recovery display, as a Virtual Instrument (VI), using a laptop computer is shown. In a typical embodiment, a program is written in National Instruments LabVIEW®. LabVIEW® programs are termed "virtual instruments" or VIs, inasmuch as they allow the computer to mimic a wide variety of instruments or devices, in this case, a swimming robot. They also provide a graphical operator interface for input to the virtual instrument. Using the wireless network feature, the operator drives the AUV by heading and thruster power via a remote control algorithm. The vehicle 30 is driven out of the launch and recovery frame 20 away from the launch vessel on the surface using the Launch/Recovery VI. The operator interface provides controls for forward and reverse thrust and starboard/port yaw of the rudder fins. The operator backs out of the launch/recovery frame 20 and has an opportunity to verify systems readiness, and change any last minute dive parameters if necessary. The AUV is now ready to submerge and depart on its assigned mission. Whenever the vehicle 30 surfaces, it rapidly reestablishes a packet modem link to the operator's laptop computer and reports its mission status. Optionally, these communication functions can be achieved by an acoustic modem while the vehicle 30 is submerged. At the end of its mission, the vehicle 30 reports its location and proceeds to a pre-arranged pickup point. It is possible to download and view data, and reprogram the vehicle 30 over the packet modem link without recovering the vehicle 30 from the water.

Figure 11:
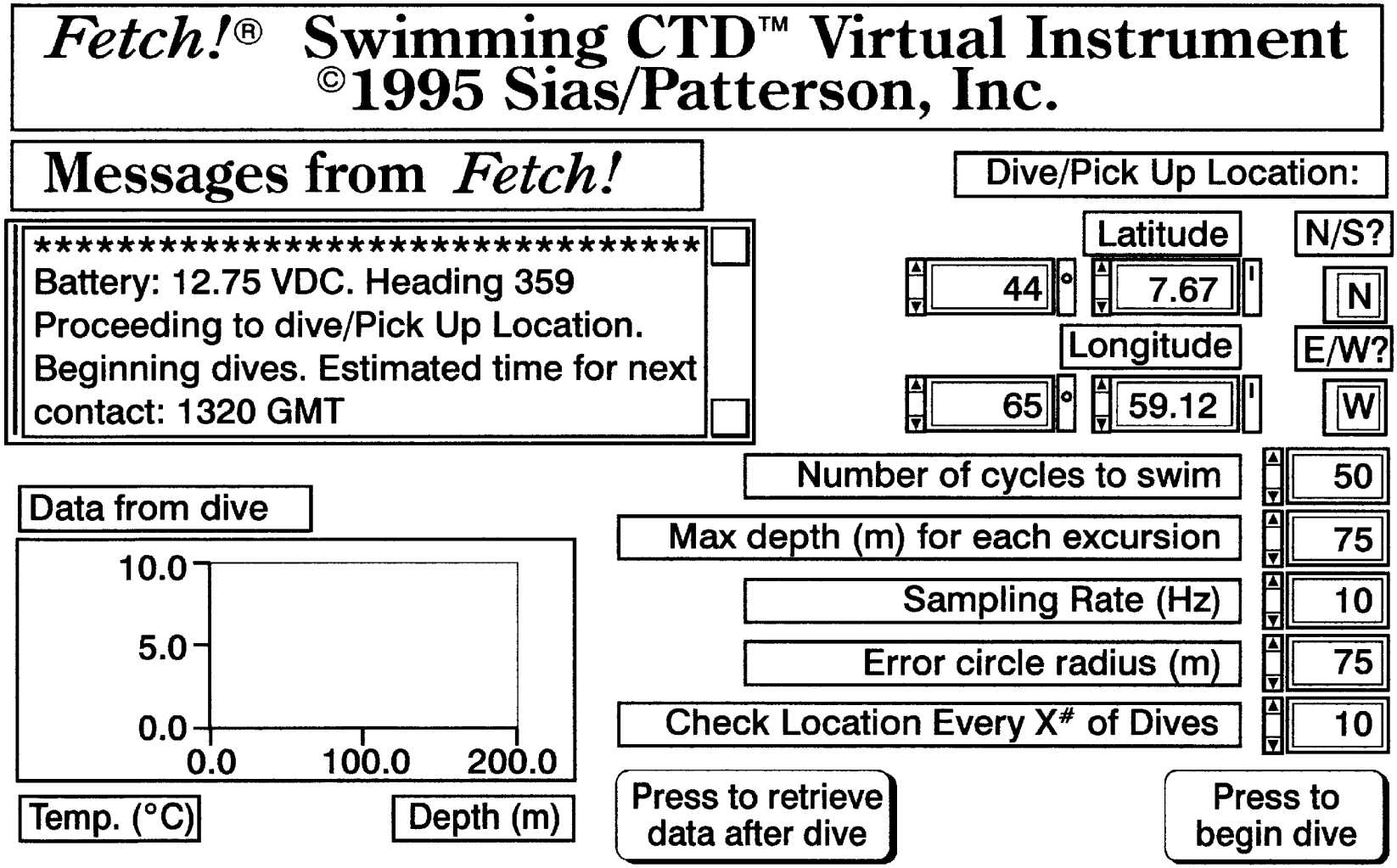
FIG. 11 is a computer control screen display for typical swimming operations of the vehicle that profile the water column.

FIG. 11 shows the VI display during typical swimming operations of the vehicle 30 when it performs repetitive profiling of the water column. The vehicle 30 is preprogrammed with instructions for its planned dive behavior using a laptop computer, or the operator's main computer, connected by a serial cable attached to the vehicle's serial port. Optionally, a wireless packet modem connection can be established between the vehicle 30 and a remote computer. The planned dive behavior is also a program written in National Instruments' LabVIEW®. On the laptop computer screen appears the front panel for the VI that will have open boxes to enter relevant dive behavior and sampling parameters. For example, in the SwimmingCTD® VI, a VI that emulates a rapid profiling CTD (Conductivity, Temperature, Depth) meter, the user enters the latitude and longitude of the desired dive site, the number of dives to execute, the depth to which the vehicle 30 should dive each time, and the sampling rate to log data from the C, T and D sensors, the error circle tolerated around the dive location, and the frequency with which the vehicle 20 checks for drift outside the error circle.

Figure 12A:
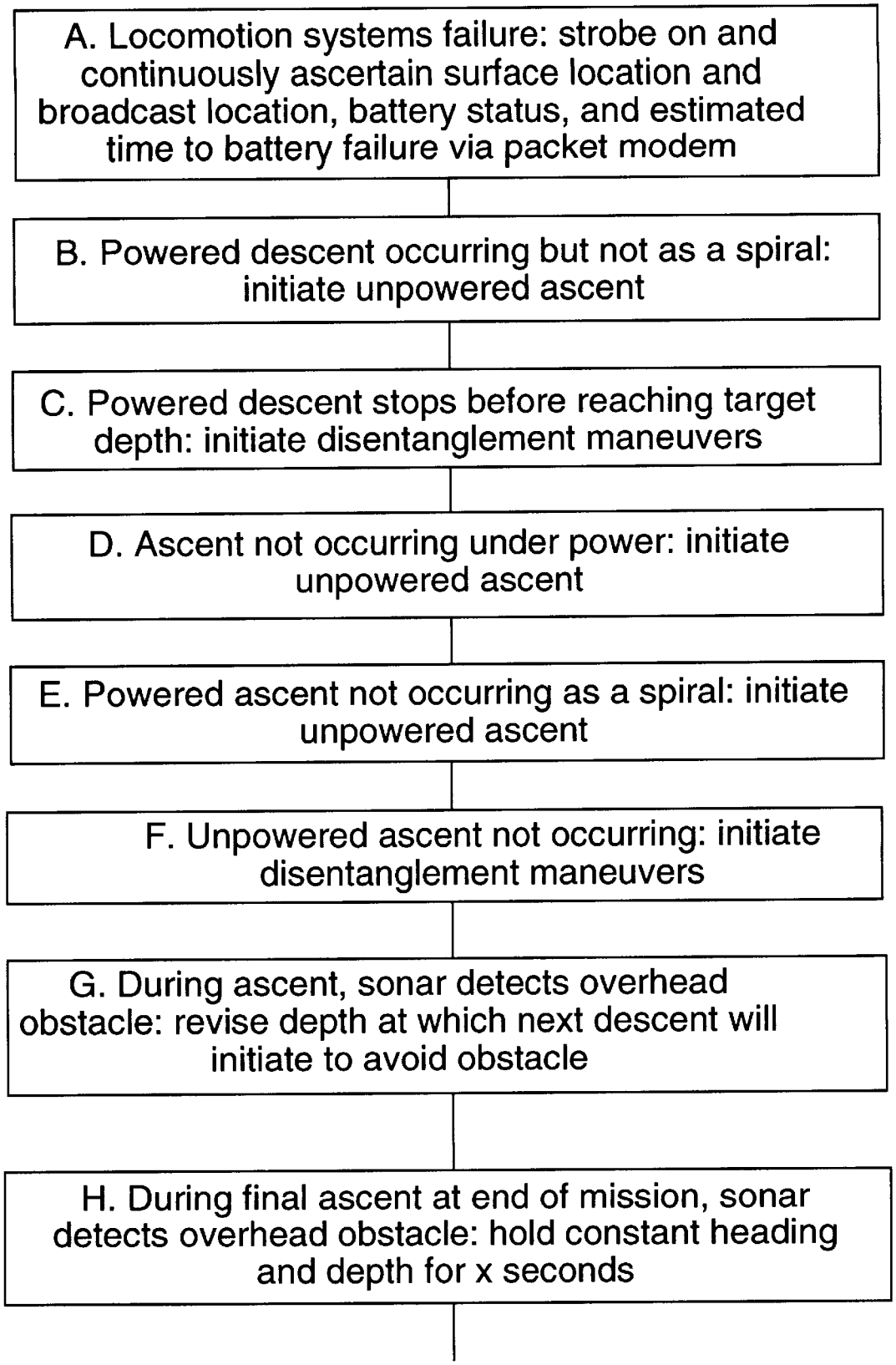
FIG. 12 is a block diagram of the software architecture used in profiling the water column, shown in the finite-state machine.
Figure 12B:
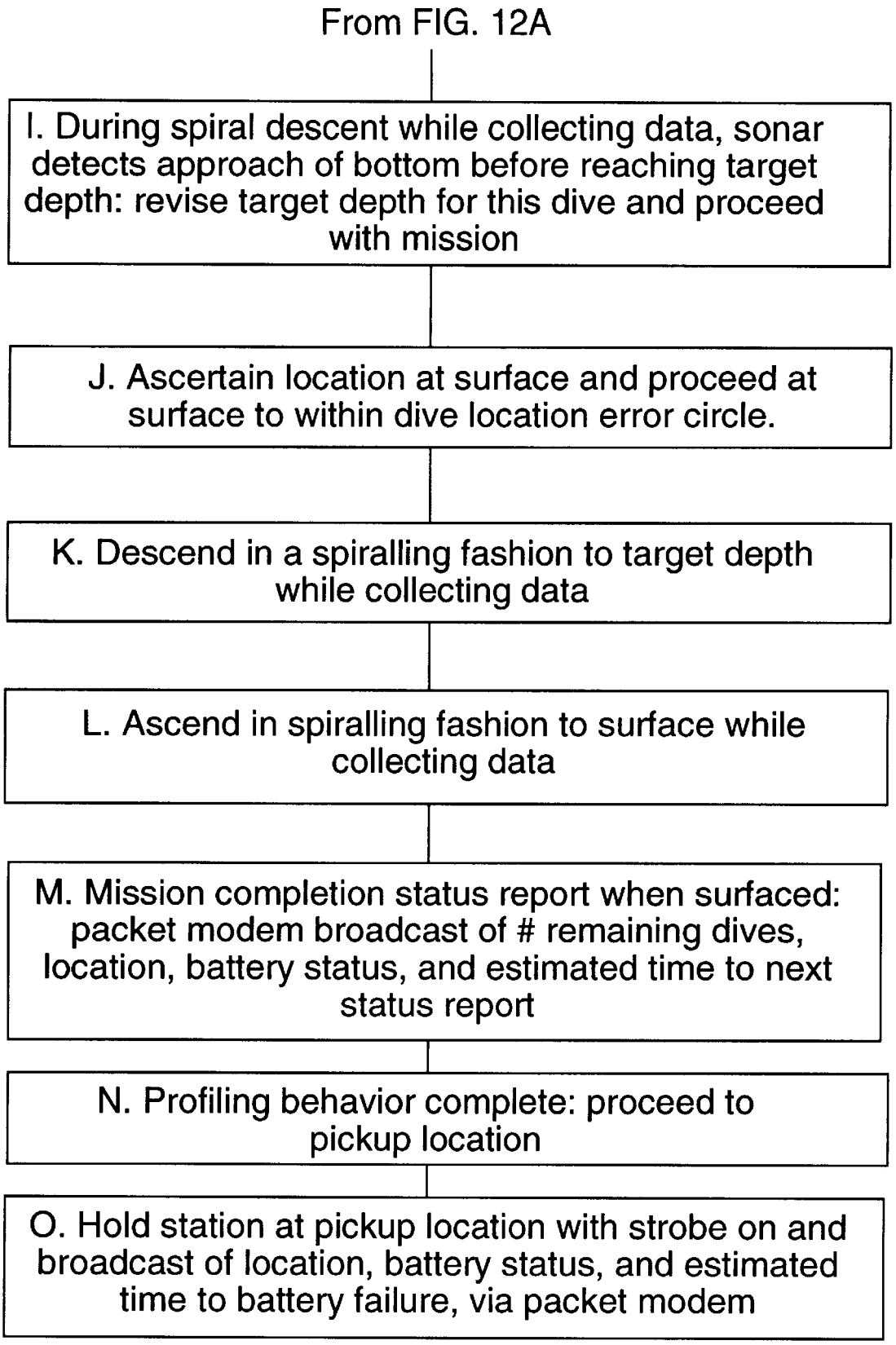

FIG. 12 depicts the finite state machine implemented in the vehicle 30 to provide CTD profiling. Normal operation is depicted by panels J–O, that is, non-error states. Panels A–I represent error states. In this implementation the vehicle 30 can jump from any panel in the series A–O to another. The diagram, therefore, is not a flow chart, but instead a record of attainable machine states. As an example, the vehicle 30 begins operation at state "J" proceeding to a surface location to commence its dive. Upon arrival at the dive location, the vehicle 30 begins its dive but approaches the sea floor before reaching the preprogrammed depth. In that event, the vehicle 30 jumps to error state I and revises the mission profile.

Figure 13:
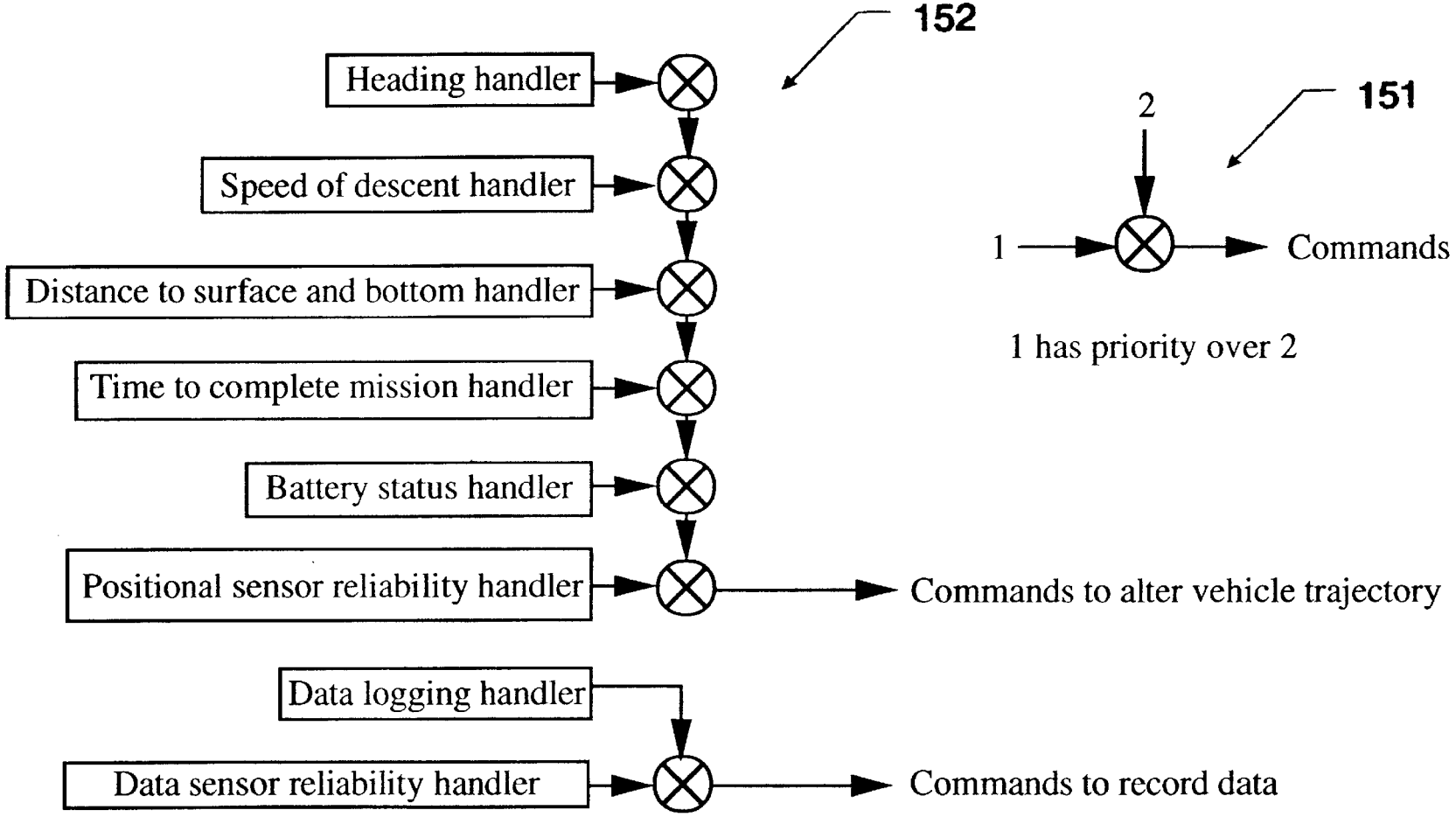
FIG. 13 is a flow chart depicting the priority system within a typical state of the finite state machine used to profile the water column.

The implementation of the finite state machine is supported by a layered control scheme shown in FIG. 13. As depicted in the priority legend 151, the column of algorithms 152 includes increasing priorities of the algorithms as one goes down the column. By this method, the items at the bottom have the greatest priority, i.e., the data sensor reliability handler has priority over the data logging handler and so on. For example, the prioritized arrangement of the algorithm depicted is typical of how state K in FIG. 12 is successfully implemented.

Figure 14:
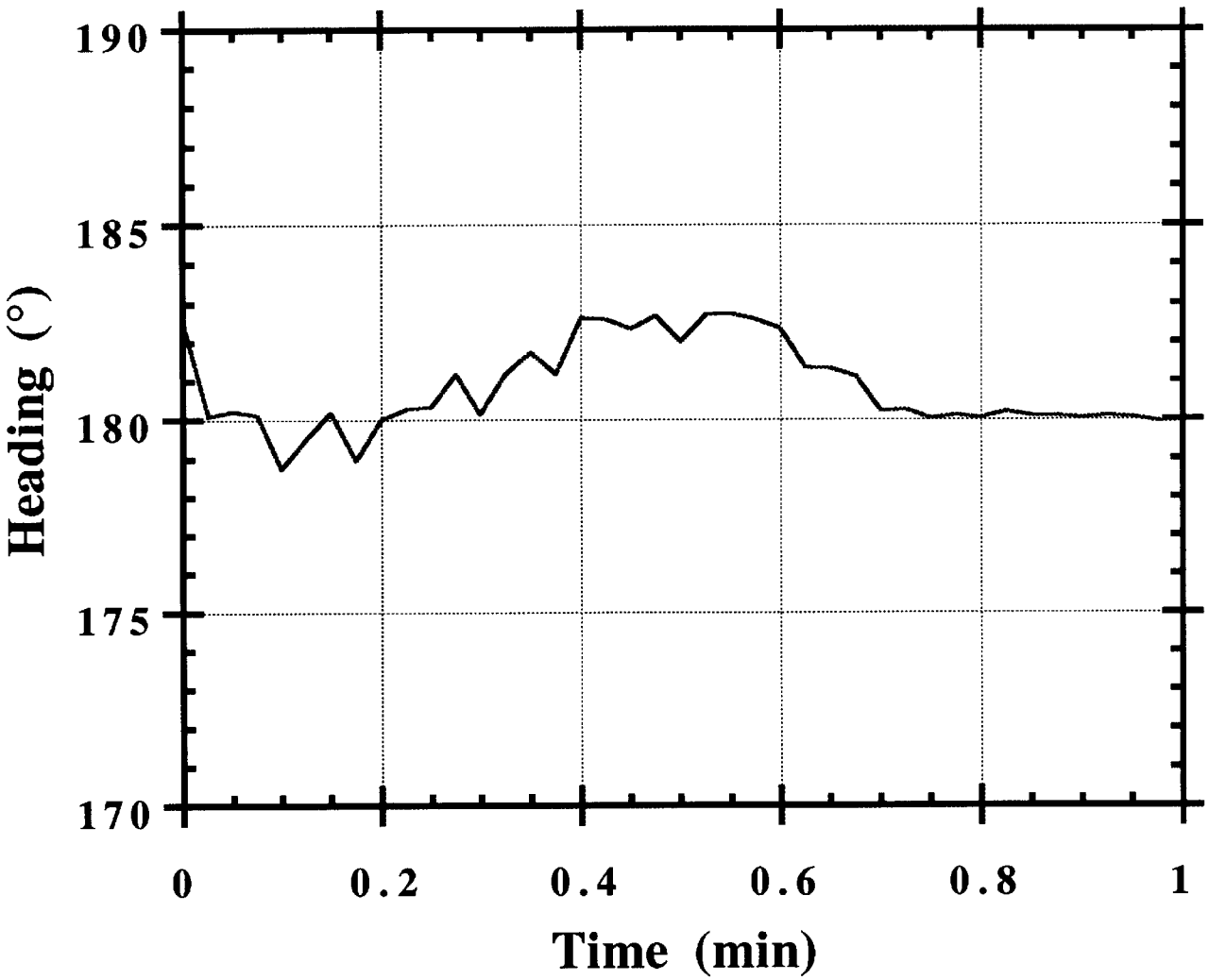
FIG. 14 is a graph showing vehicle heading control compared to time.
Figure 15:
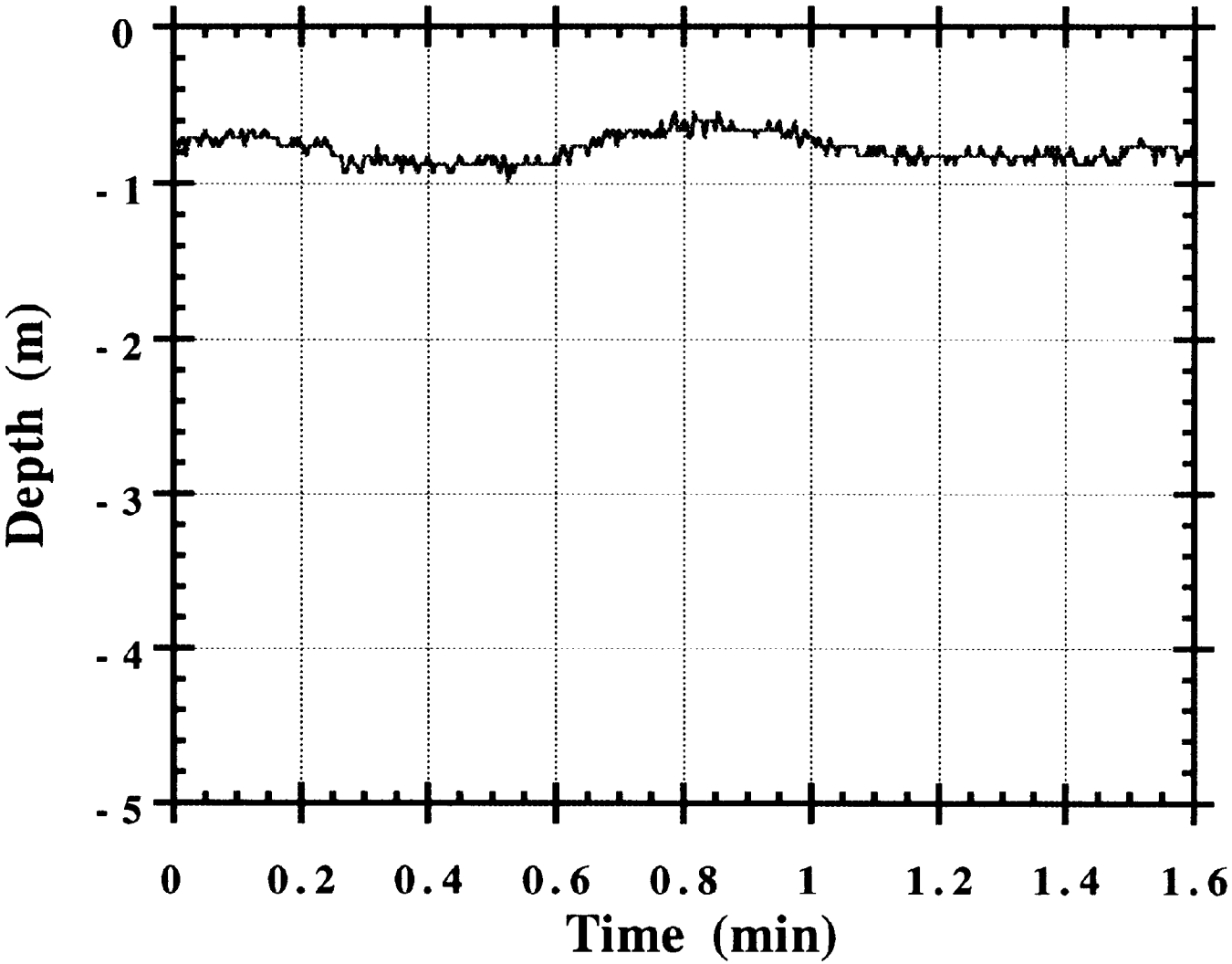
FIG. 15 is a graph showing vehicle depth control compared to time.

FIG. 14 gives data from field trials of the vehicle's course holding. FIG. 15 depicts field trials of depth holding. Mission parameters called for the vehicle 30 to maintain a heading of 180 degrees at a depth of one meter. Motion algorithms for the control surfaces employ Proportional Integral Derivative (PID) control but other control modes will also work including P, PI, and various non-linear schemes such as sliding mode.

Figure 16:
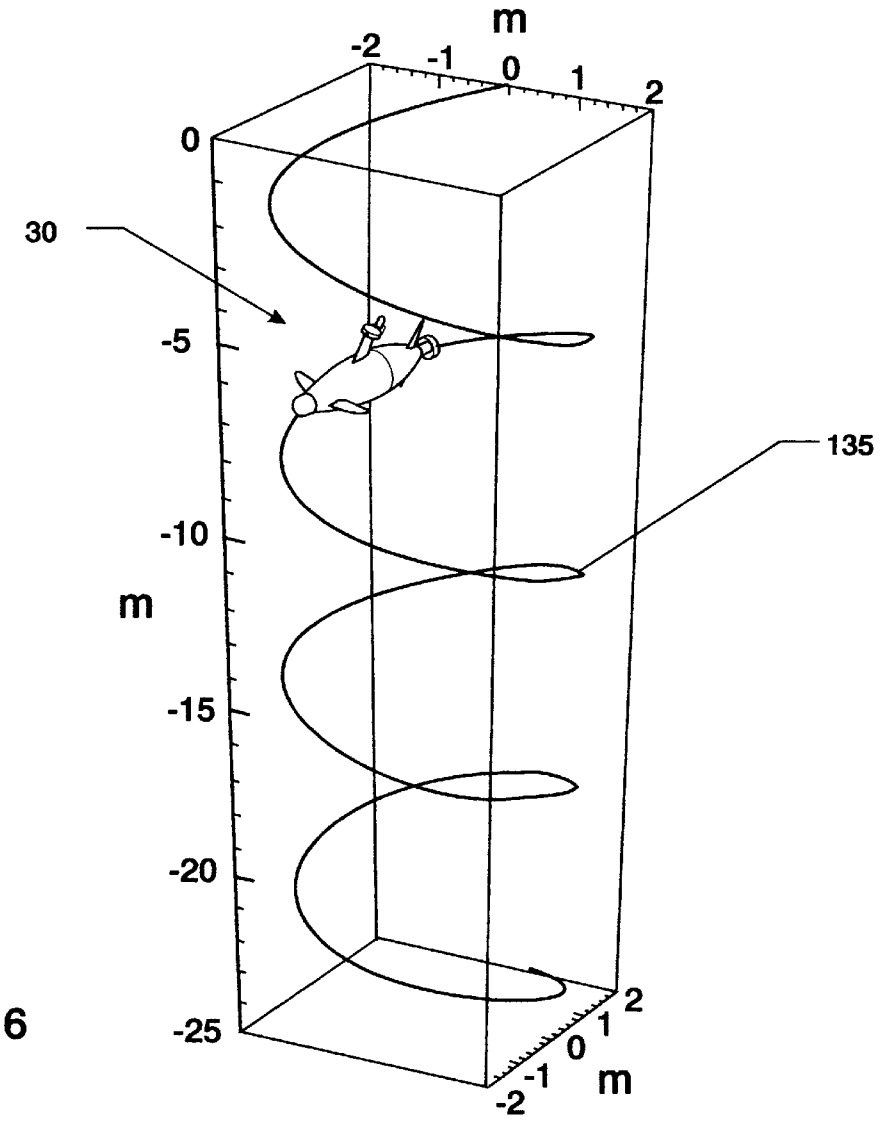
FIG. 16 is a perspective view of the vehicle in a typical spiral descent used to collect water column profile data.

FIG. 16 illustrates the typical spiral descent 135 used by the vehicle 30 to such water column variables as temperature and conductivity. During this type of maneuver, the vehicle 30 operates through its finite state machine algorithm, using the error states to correct any operational problems such as entanglement, impending collision, or system malfunction.

Figure 17:
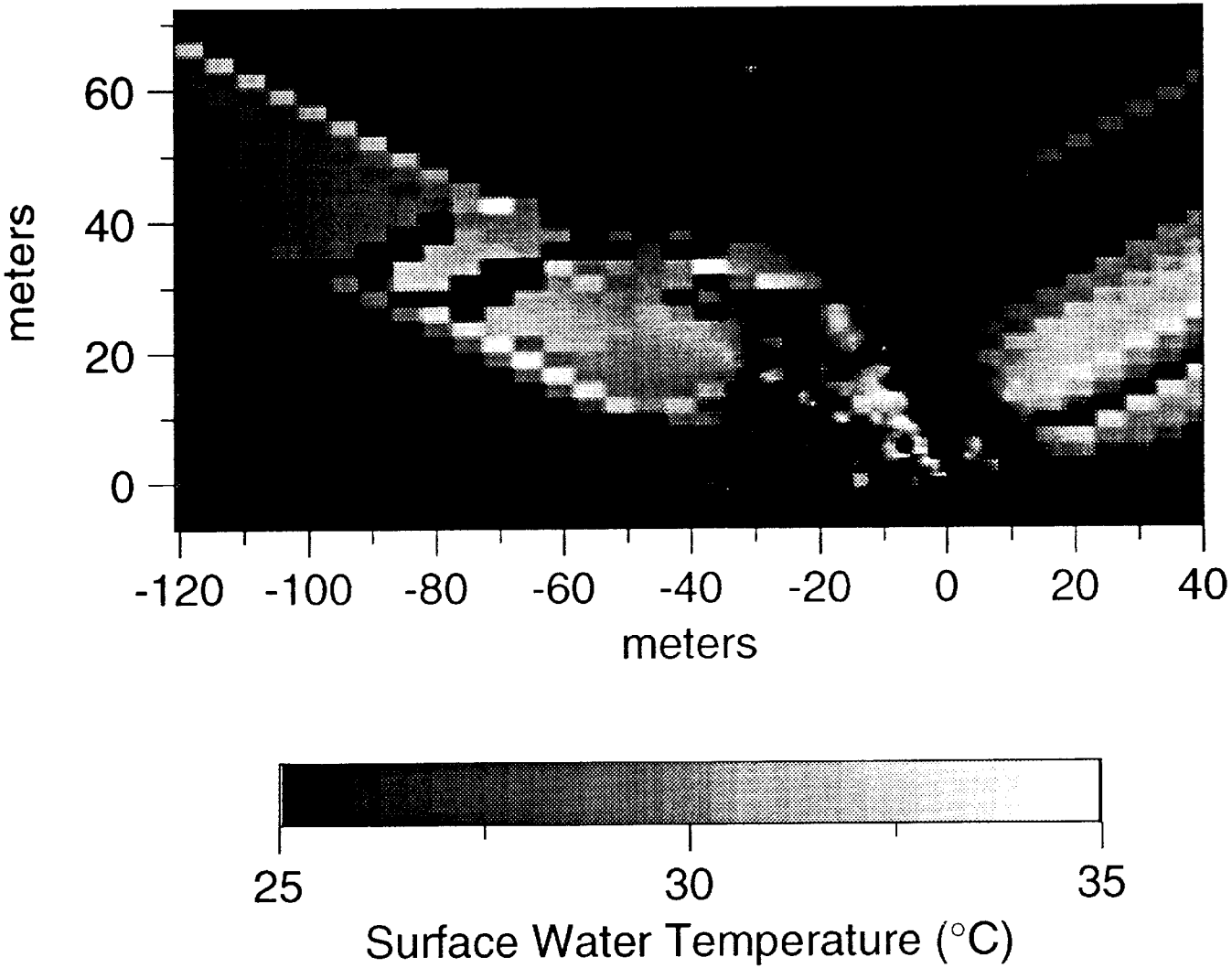
FIG. 17 is a data chart depicting a two-dimensional temperature field as plotted by the vehicle.
Figure 18:
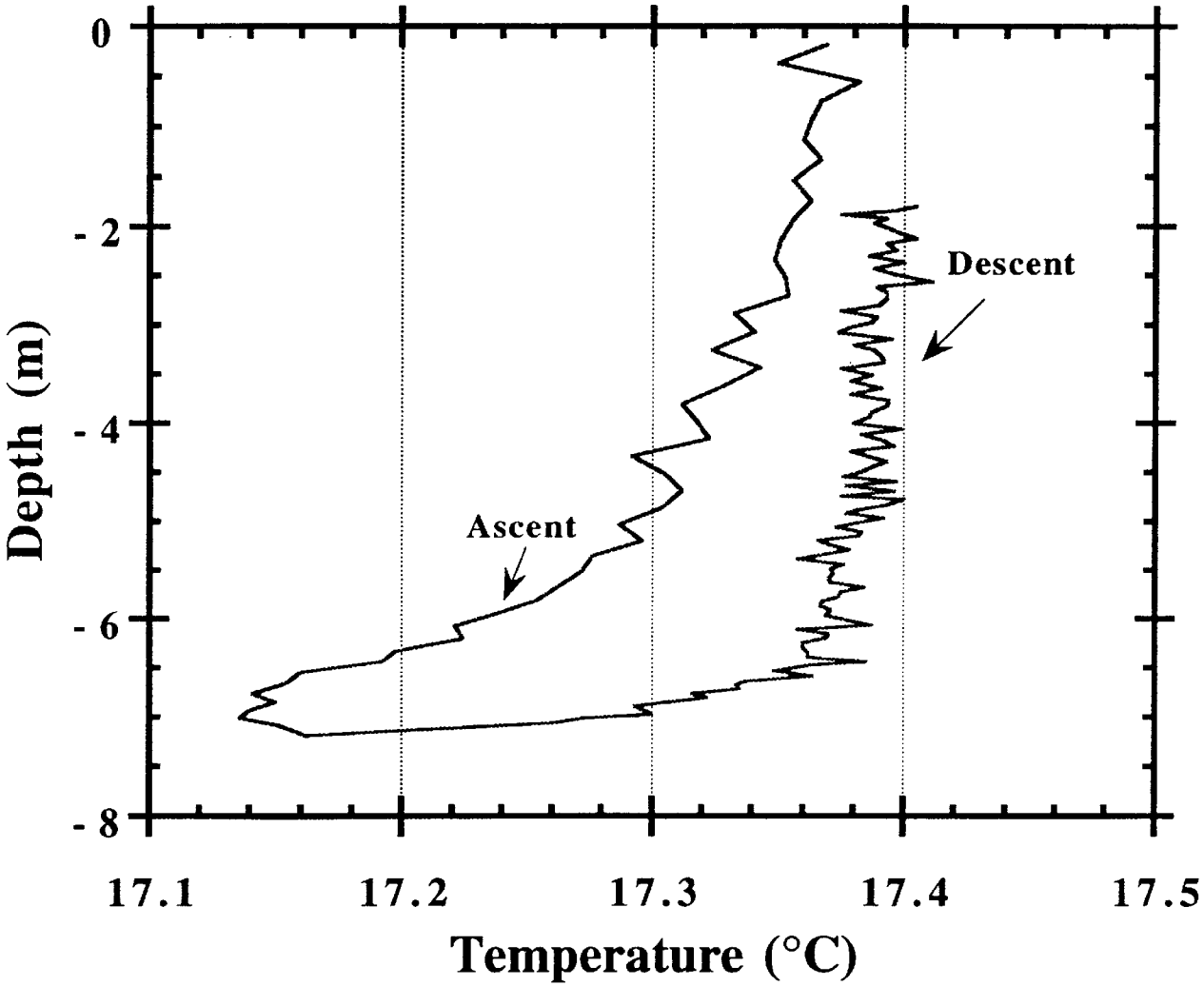
FIG. 18 is a graph depicting temperature as a function of depth as plotted by the vehicle.
Figure 10:
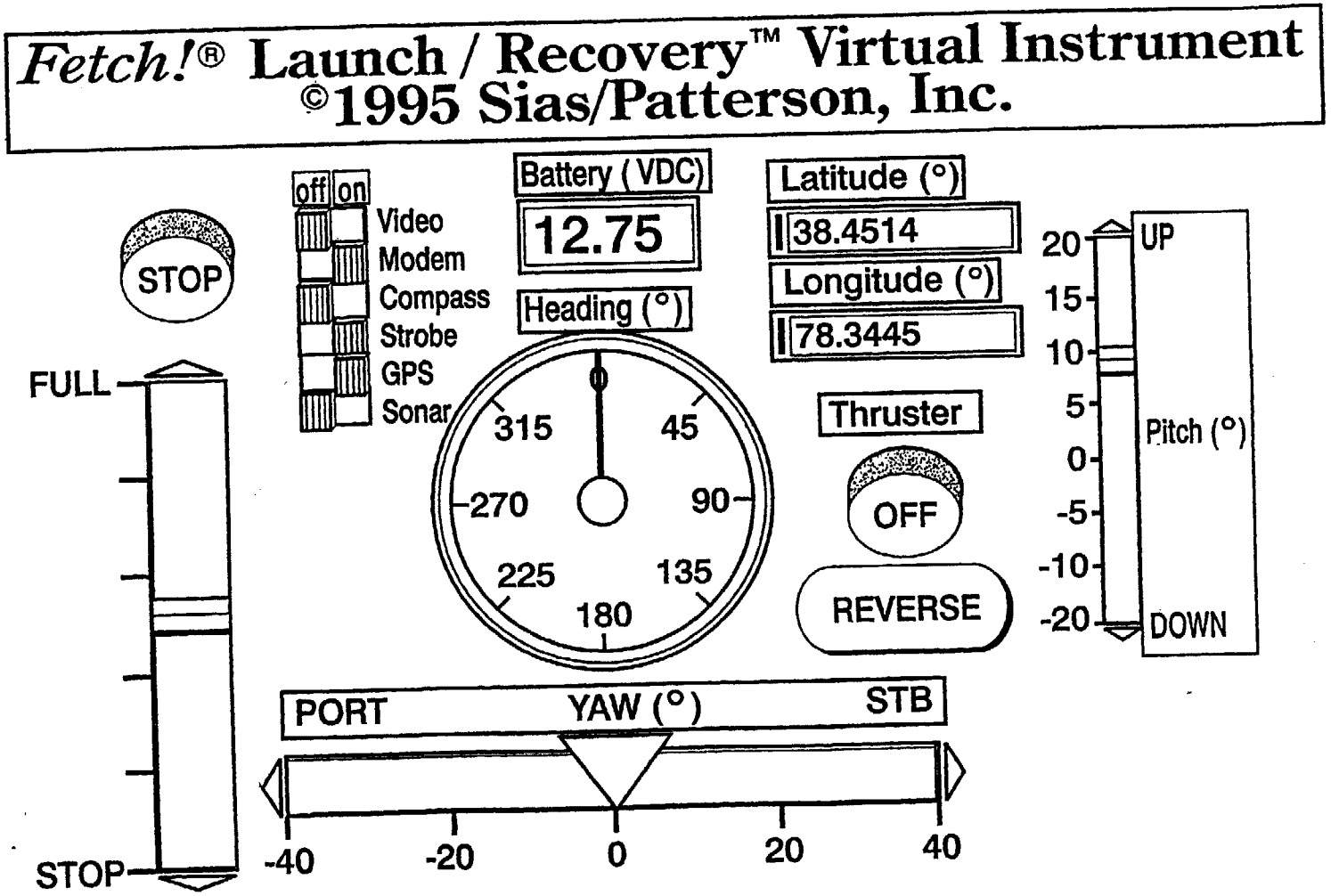

Upon return from a successful mission, the vehicle 30 produces data such as shown in FIGS. 17 and 18.

FIG. 17 shows surface water temperature in the Chesapeake Bay over a football field sized area. Swimming speed of vehicle was c. 2.0 meters/second. The temperature distribution was measured with 7 runs originating at the origin, and took approximately 5 minutes of run time. These data were interpolated using a standard statistical algorithm, in this case a kriging algorithm.

As another example of the vehicle's data gathering abilities, FIG. 18 shows temperature data from the water column of a quarry gathered while the vehicle 30 emulated a CTD instrument. Note that this water body is nearly isothermal, yet the vehicle 30 successfully measured the thermocline present in this body of water.

The features and advantages of the present invention are numerous. The modular autonomous underwater vehicle system provides a novel configuration using largely off-the-shelf components, thereby allowing a significant drop in development time and allowing incremental upgrades during the vehicle life-cycle. These benefits include the ease of fabricating new units, lower maintenance and field repair costs, and ability to leverage improved performance as improvements are made by the Original Equipment Manufacturers (OEMs) of the subcomponents. For example, if the main computer of the vehicle is designed around an off-the-shelf CPU and operating system, subsequent models of the CPU released by the manufacturer almost always will provide improved computational ability. By substituting these improved CPU's, a vehicle can achieve increased capabilities throughout its life-cycle thereby avoiding or delaying obsolescence.

Although the invention has been described relative to a specific embodiment thereof, there are numerous variations and modifications, such as sensor and CPU substitutions, that will be readily apparent to those skilled in the art in the light of the above teachings. It is therefore to be understood that, within the scope of the appended claims, the invention may be practiced other than as specifically described for performing repetitive dives at a pre-arranged pickup point. Other AUV behaviors are easily implemented including, but not limited to, such tasks as large area surveys and terrain following.

What is claimed as new and desired to be secured by Letters Patent of the United States is:

1. A modular autonomous underwater vehicle system having a vehicle and launch and recovery frame assembly comprising:

a removable nose cone adapted for mounting standard or custom sensors;

a plurality of sensors mounted in said nose cone;

a pressure forward hull section, connected to said nose cone, and having internal mounting for a navigation and data collection computer, for a power supply, and for dive plane actuator mechanisms;

a pressure aft hull section, connected to said forward hull section and having internal mounting for a power supply, for a power control module, and for rudder actuator mechanisms;

a motor mount section, connected to but pressure isolated from, said pressure aft hull, containing electrical drive motor and associated electrical connections;

a strobe and antennae tower containing packet modem antenna, GPS antenna, and high intensity strobe light;

a packet modem and GPS receiver module located inside said forward hull;

a plurality of batteries mounted inside said forward hull section;

a navigation and data collection computer mounted inside said forward hull section;

dive planes located on and extending horizontally from both sides of said forward hull section;

rudder fins located on and extending vertically from both sides of said aft hull section;

a DC thruster motor mounted in said motor mount section;

a battery charging port and high speed serial port located on said motor mount section;

an array of interconnected internal components comprising four stepping motors, one for each of said dive planes and rudder fins located in the forward and aft hulls, respectively, an I/O block, located on said forward hull, for connection to said sensors located in the nose cone or elsewhere in the vehicle; and a floating launch and recovery frame, attachable to said vehicle, for assembling and launching said underwater vehicle.

2. A modular autonomous underwater vehicle system as in claim 1 wherein said computer has I/O architecture having platform independence, thereby allowing substitution of a variety of CPUs.

3. A modular autonomous underwater vehicle system as in claim 2 wherein said computer has a plurality of analog-to-digital converter channels and digital I/O channels and at least one digital-to-analog output channel.

4. A modular autonomous underwater vehicle system as in claim 3 wherein said computer I/O architecture has a graphical operator interface.

5. A modular autonomous underwater vehicle system as in claim 4 wherein said I/O architecture is a layered software structure providing a finite state machine.

6. A self-contained modular autonomous underwater vehicle system having a method for profiling a water column comprising the steps of:

ascertaining location of the vehicle at the surface;

proceeding to the user specified dive location;

descending in a spiraling fashion to the target depth while collecting data;

ascending to the surface in a spiraling fashion while collecting data;

periodically ascertaining drift from the dive location and reporting vehicle and mission status;

assessing reliability of vehicle sensors;

returning to the pickup location after the mission; and holding station at the pickup location while broadcasting vehicle status sequencing the normal states of AUV operation to accomplish the desired mission;

defining the error states of AUV operation which interfere with mission completion;

providing corrective actions for each error state; and linking the preceding states as a finite state machine.

7. A self-contained modular autonomous underwater vehicle system as in claim 6 wherein said step of defining the error states further comprises:

ascertaining locomotion systems failure;

detecting entanglement;

detecting collisions with the bottom or objects in the water column or at the surface; and assessing reliability of vehicle sensors.

8. A self-contained modular autonomous underwater vehicle system as in claim 6 wherein said step of providing corrective actions further comprises:

broadcasting messages of vehicle distress and location;

illuminating the high intensity strobe;

initiating unpowered ascents when appropriate;

initiating disentanglement maneuvers; and avoiding collision with the bottom or objects.

* * * * *

(Also Form PTO-1050)

UNITED STATES PATENT AND TRADEMARK OFFICE

CERTIFICATE OF CORRECTION

PATENT NO : 5,995,882

DATED : November 30, 1999

INVENTOR(S) : Mark R. Patterson, James H. Sias

It is certified that error appears in the above-identified patent and that said Letters Patent is hereby corrected as shown below:

On the title page: Inventors ([76]), line 1, change "1489" to --1484--. Please refer to attached Declaration submitted with initial application which indicates the correct address.

column 2, line 19, insert --)-- after "(CPU)".

UNITED STATES PATENT AND TRADEMARK OFFICE

CERTIFICATE OF CORRECTION

PATENT NO. : 5,995,882
DATED : November 30, 1999
INVENTOR(S) : Mark R. Patterson, James H. Sias It is certified that error appears in the above-identified patent and that said Letters Patent is hereby corrected as shown below:

The Drawing , consisting of Fig. 10 , should be deleted to be replaced with the Drawing Sheet, consisting of Fig. 10, as shown on the attached page.

Signed and Sealed this

Thirteenth Day of March, 2001

*Attest:*

Nicholas P. Godici

NICHOLAS P. GODICI

*Attesting Officer*

*Acting Director of the United States Patent and Trademark Office*